US005800216A

United States Patent [19]

Okada

[11] Patent Number: 5,800,216

[45] Date of Patent: *Sep. 1, 1998

[54] ELECTRICAL CONNECTOR

[75] Inventor: Naohisa Okada, Yokkaichi, Japan

[73] Assignee: Sumitomo Wiring Systems, Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 633,460

[22] Filed: Apr. 17, 1996

[30] Foreign Application Priority Data

Apr. 18, 1995 [JP] Japan ..... 7-117828

[51] Int. Cl.[6] ..... H01R 13/436

[52] U.S. Cl. ..... 439/752

[58] Field of Search ..... 439/752, 595

[56] References Cited

U.S. PATENT DOCUMENTS

| | | | |
|---|---|---|---|
| 5,209,676 | 5/1993 | Endo et al. | 439/752 |
| 5,316,504 | 5/1994 | Jinno | 439/752 |
| 5,346,414 | 9/1994 | Sakai et al. | 439/752 |
| 5,378,176 | 1/1995 | Sasai | 439/752 |

FOREIGN PATENT DOCUMENTS

| | | |
|---|---|---|
| 0 596 707 A1 | 5/1994 | European Pat. Off. . |
| 0 644 620 A3 | 3/1995 | European Pat. Off. . |

*Primary Examiner*—Gary F. Paumen
*Attorney, Agent, or Firm*—Banner & Witcoff, Ltd.

[57] ABSTRACT

An electrical connector comprises a housing, a plurality of laterally-spaced parallel cavities formed in the housing for receiving terminals, and a retainer for holding the terminals within the cavities. A respective window joins each of the cavities to the exterior of the housing, the windows being positioned within a housing face overlying the cavities. The retainer has a base, a pair of arms extending away from the ends of the base, and a plurality of claws positioned between the arms and extending away from the base in a given direction. The retainer is such that, in use, its base overlies said housing face, its arms clamp a pair of housing faces adjacent to said housing face, and the claws are aligned with the windows. The retainer is movable with respect to the housing in a first direction from a first position in which the claws lie outside the windows, to a second position, in which the claws have entered the windows. The retainer and the housing are provided with interengageagble locking means for resisting movement of the retainer from the second position to the first position in a direction opposed to the first direction.

12 Claims, 4 Drawing Sheets

ELECTRICAL CONNECTOR

FIELD OF THE INVENTION

This invention relates to an electrical connector, and in particular to a connector having a C-shaped retainer.

BACKGROUND OF THE INVENTION

A conventional electrical connector has a retainer with arms projecting from both extremities of a base, the retainer being supported by inserting its arms into the housing of the connector. Interengageable means, that also serve as a guide, are formed on the arms and on the side faces of the housing. The retainer can be fixed at a fully-fitted position, where retainer claws come to rest after entering terminal fitting insertion chambers; and at an intermediate position, where the retainer claws are withdrawn from the terminal fitting insertion chambers.

In the conventional connector described above, the retainer is arranged to be attached by engagement of the interengageable means as the retainer moves from the intermediate position to the fully-fitted position. There is a problem here in that the force which resists movement of the retainer from its intermediate position to its fully-fitted position is weak.

Moreover, when the retainer is forced to the rear, it rotates, since the force applied is not necessarily parallel with respect to the housing. As a result, the arms tend to rise, and the force that resists movement to the rear decreases.

SUMMARY OF THE INVENTION

The aim of the invention is to provide an electrical connector which resists an easy return to the intermediate position from the fully-fitted position.

The present invention provides an electrical connector comprising a housing, a plurality of laterally-spaced parallel cavities formed in the housing for receiving terminals, and a retainer for holding the terminals within the cavities, a respective window joining each of the cavities to the exterior of the housing, the windows being positioned within that housing face overlying the cavities, the retainer having a base, a pair of arms extending away from the ends of the base, and a plurality of claws positioned between the arms and extending away from the base in a given direction, the retainer being such that, in use, its base overlies said housing face, its arms clamp a pair of housing faces adjacent to said housing face, and its claws are aligned with the windows, the retainer being movable with respect to the housing in a first direction from a first position in which the claws lie outside the windows, to a second position in which the claws have entered the windows, wherein the retainer and the housing are provided with interengageable locking means for resisting movement of the retainer from the second position to the first position in a direction opposed to the first direction.

When the retainer is subjected to a rotational force applied at its front, those portions of the retainer adjacent to the arms at the rear of the base try to move in response. However, the engagement of the locking means on the retainer and the housing prevent this movement.

The invention also provides an electrical connector comprising a housing, first and second rows of laterally-spaced parallel cavities formed in the housing for receiving terminals, a respective first window joining each of the cavities of the first row to the exterior of the housing, the first windows being positioned within a first housing face overlying the cavities of the first row, a respective second window joining each of the cavities of the second row to the exterior of the housing, the second windows being positioned in a second housing face overlying the cavities of the second row, and a respective retainer for holding the terminals within the cavities of the first and second rows, each retainer having a base, a pair of arms extending away from the ends of the base, and a plurality of claws positioned between these arms and extending away from that base in a given direction, each retainer being such that, in use, its base overlies the respective first and second housing face, its arms clamp a pair of housing faces adjacent to the respective first or second housing face, and its claws are aligned with the first or second windows, each retainer being movable with respect to the housing in a first direction from a first position in which its claws lie outside the associated windows, to a second position in which the claws have entered the associated windows, wherein the retainers and the housing are provided with interengageable locking means for resisting movement of each retainer from its second position to its first position in a direction opposed to the first direction.

In a preferred embodiment, the locking means of the or each retainer is constituted by locking devices positioned at the ends of the base of that retainer and at regions of that base remote from the free ends of the claws. In this case, the locking devices may be constituted by projections which, in use, mate with cut-outs formed in the housing.

Additionally, or alternatively, the locking means of the or each retainer may be constituted by laterally-extending locking means positioned in the central region of the base of that retainer. Advantageously, the laterally-extending locking means of the or each retainer is constituted a laterally-extending slot which, in use, mates with one or more laterally-extending locking projections slot formed in the housing. In this case, the interengaging locking means on the retainer and the housing can extend over a substantial proportion of the width of the connector, thereby increasing the resistance to movement of the retainer in relation to the housing.

Preferably the free ends of the arms of the or each retainer define inclined end surfaces which are slidingly engageable with complementary inclined surfaces formed on the housing.

BRIEF DESCRIPTION OF THE DRAWINGS

The invention will now be described in greater detail, by way of example, with reference to the drawings, in which.

DESCRIPTION OF PREFERRED EMBODIMENTS

Figure 1:
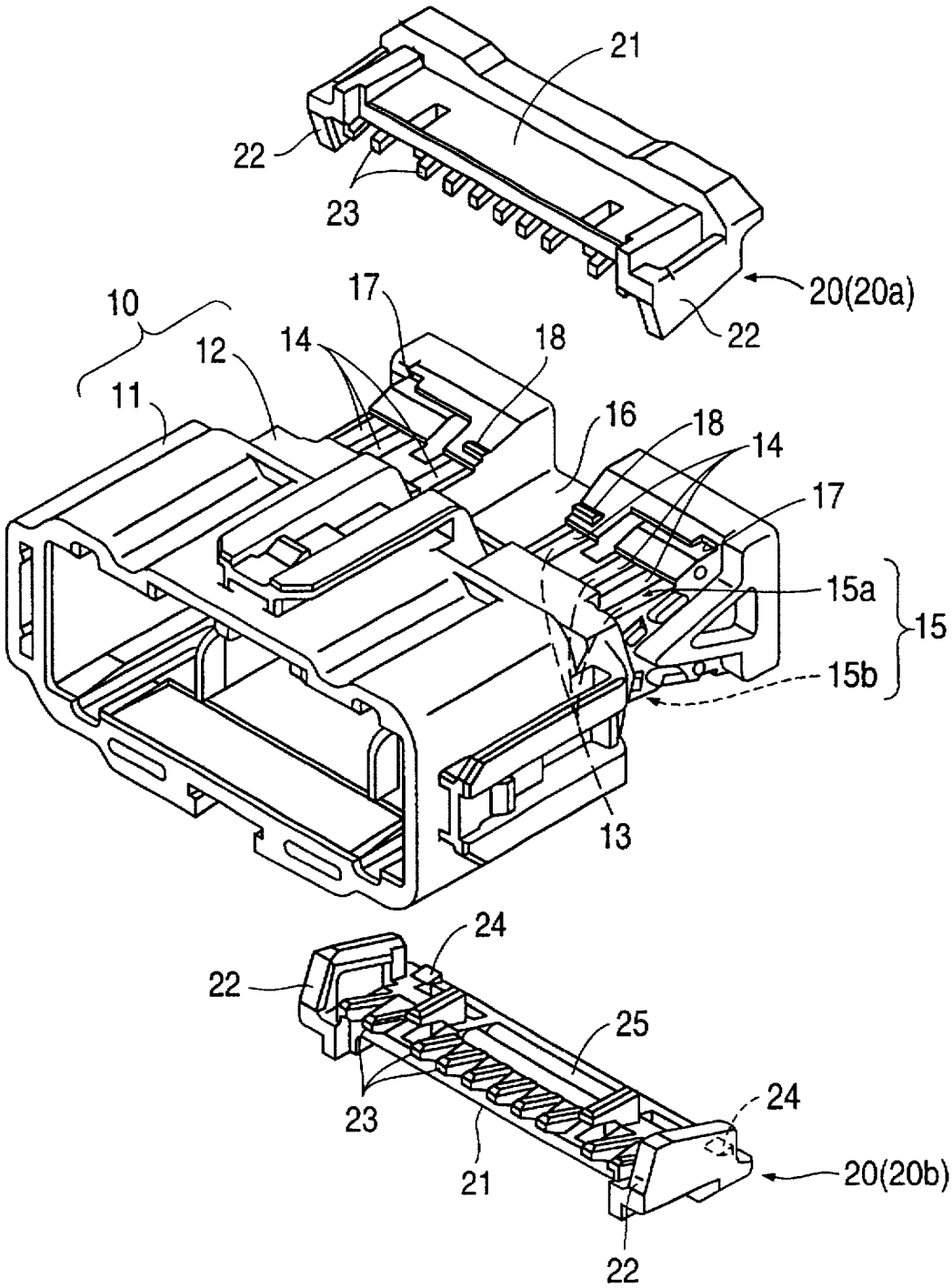
FIG. 1 is an exploded perspective view of a male connector constructed in accordance with the invention.

Referring to the drawings, FIG. 1 shows a male connector 10 having a housing 12 formed with a hood 11 at its front end. The housing 12 is formed with a plurality of parallel, horizontal cavities 13 which are located in upper and lower rows. Each cavity 13 has a window 14 that opens out, either towards the upper face or the lower face of the housing 12 depending upon whether that cavity is in the upper or lower row. These upper and lower faces define retainer attachment faces 15*a* and 15*b* for attaching a two-part retainer 20 (20*a* and 20*b*). The upper face of the housing 12 is formed with a central recess 16, the upper retainer attachment face 15*a* being positioned on either side of this recess.

The retainer member 20*a* has a laterally-extending base 21 which, in use, covers the upper face of the rear end of the housing 12. Similarly, the retainer member 20*b* has a base 21 for covering the lower face of the rear end of the housing 12. Arms 22 extend substantially at right-angles from both ends of each base 21, so that each retainer member 20*a* and 20*b* is generally C-shaped in cross-section. The arms of each retainer member 20*a* and 20*b* clamp, in use, the side faces of the housing 12 from both sides.

The upper and lower faces of the housing 12 are formed with inclined edge portions which, in use, engage with inclined end surfaces of the arms 22 of the retainer members 20*a* and 20*b* to permit the retainer members to slide onto the housing 12, from the rear, into either an intermediate position or a fully-fitted position (to be described below).

As each retainer member 20*a* and 20*b* approaches, or moves away from, its fully-fitted position (shown in FIG. 3), claws 23 formed on its front end move into, or out of, the cavities 13 via the windows 14. In other words, the retainer claws 23 gradually enter the cavities 13 as they move from the rear ends of the windows to the front ends thereof. In the intermediate position (see FIG. 2), the claws 23 are free of the cavities 13. A respective terminal fitting (not shown) is insertable into each of the cavities 13 from an opening located at the rear end thereof. Once the retainer members 20*a* and 20*b* are slid to the front end of the housing 12, the retainer claws 23 enter the cavities 13 via the windows 14 and make contact with respective inclined stop members (not shown) thereby doubly stopping it.

The retainer attachment faces 15*a*, 15*b* are formed with cut-outs 17 in positions which are adjacent to the roots of the arms 22 when the retainer members 20*a* and 20*b* move to their fully-fitted positions, the roots of the arms constituting the rear ends of the bases 21 of the retainer members. The retainer members 20*a* and 20*b*, are formed with projections 24 that, in use, mate with the cut-outs 17. Alternatively, the cut-outs 17 could be formed on the retainer members 20*a* and 20*b* and the projections 24 could be formed on the retainer attachment faces 15*a*, 15*b*. Either way, the projections 24 will mate with the cut-outs 17 when an attempt is made to move the retainer members 20*a* and 20*b* to the rear, thereby inhibiting such a movement.

The retainer attachment face 15*a* is also formed with projections 18 which extend laterally away from the central recess 16. These projections 18 are aligned with the base 21 of the retainer member 20*a* when the latter moves into the fully-fitted position, the projections 18 mating with a laterally-extending slot 25 formed in the retainer member 20*a* in this position. Similarly, the retainer attachment face 15*b* is formed with a laterally-extending projection 18 (not shown) which mates with a laterally-extending slot 25 formed in the base 21 of the retainer member 20*b*. Alternatively, other means for controlling rotation of the retainer members 20*a* and 20*b* relative to the housing 12 could be provided in place of the laterally-extending projections 18 and slots 25.

Figure 2:
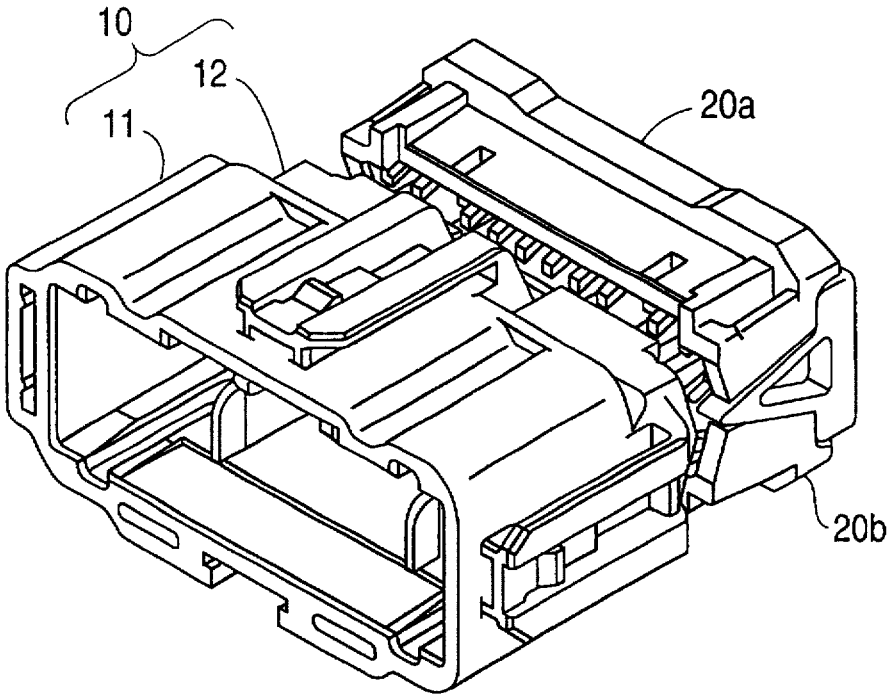
FIG. 2 is a perspective view of the connector of FIG. 1 with its retainer in an intermediate position.
Figure 3:
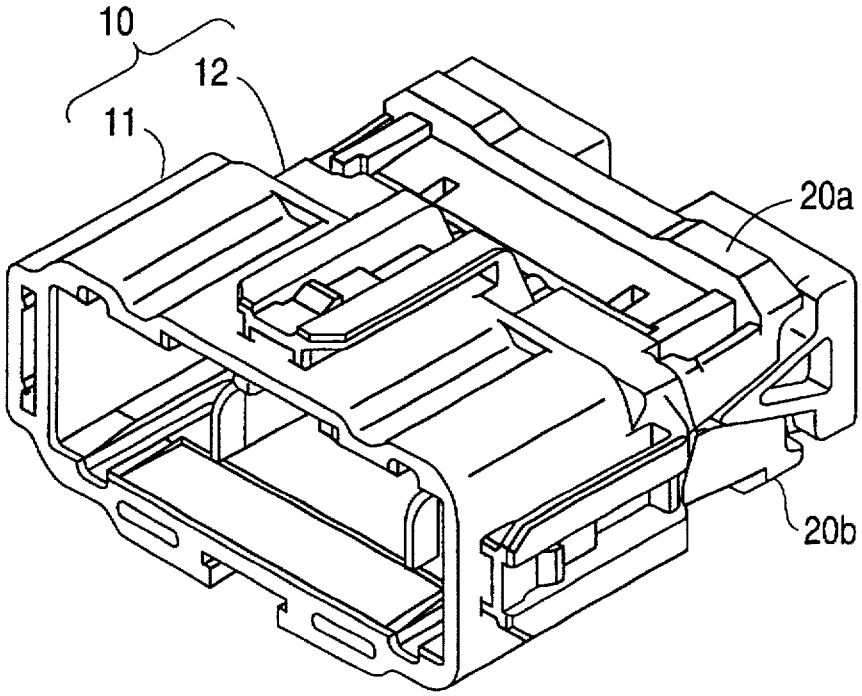
FIG. 3 is a perspective view of the connector of FIG. 1 with its retainer in a fully-fitted position.

In use, the retainer members 20*a* and 20*b* are fixed in the intermediate position shown in FIG. 2, by attaching these to the retainer attachment faces 15*a* and 15*b* of the housing 12. At this juncture, the projections 24 of the retainer members 20*a* and 20*b* have not entered the cut-outs 17 of the housing 12. Moveover, the projections 18 of the housing 12 have not entered the slots 25 of the retainer members 20*a* and 20*b*. When the retainer members 20*a* and 20*b* are moved to the fully-fitted position shown in FIG. 3, from the intermediate position, the retainer claws 23 enter the windows 14 and doubly stop the terminal fittings inside. At the same time, the projections 24 of the retainer members 20*a* and 20*b* enter and mate with the cut-outs 17 of the housing 12. Moreover, the projections 18 of the housing 12 enter and mate with the slots 25 of the retainer members 20*a* and 20*b*.

Now, assume that a force is applied which tends to return and the retainer members 20*a* and 20*b* to the intermediate position. As described earlier, if an equal force is applied to the left and right sides of the retainer members 20*a* and 20*b*, this force is counteracted by the interengagement of the arms 22 and the housing 12. However, if unequal forces are applied to these sides, the retainer members 20*a* and 20*b* tend to tilt. As the retainer members 20*a* and 20*b* begin to rotate, the mating engagement of the projections 24 and the cut-outs 17 prevents rotation of the retainer members, and also prevent them from returning to the intermediate position. Moreover, the mating engagement of the projections 18 and the slots 25 of the retainer members 20*a* and 20*b*, also counteracts the rotational force, further resisting return to the intermediate position.

In this way, the portions of the arms 22 constituting the rear ends of the bases 21 of the retainer members 20*a* and 20*b*, and the portions of the housing 12 facing said portions define interengageable means constituted by the projections 24 and the cut-outs members 17 respectively. This provides a counteracting force against any rotational force applied to the retainer members 20*a* and 20*b* and thereby holds these embers in their fully-fitted positions. Moreover, each of the retainer members 20*a* and 20*b* is similarly prevented from rotating, and is maintained in the fully-fitted position since the projections 18 engage the slots 25 of the retainer members. In other words, any force tending to rotate the retainer members 20*a* and 20*b* is efficiently counteracted, thereby preventing rotation of these members. As a result, movement towards the intermediate position is prevented.

Figure 4:
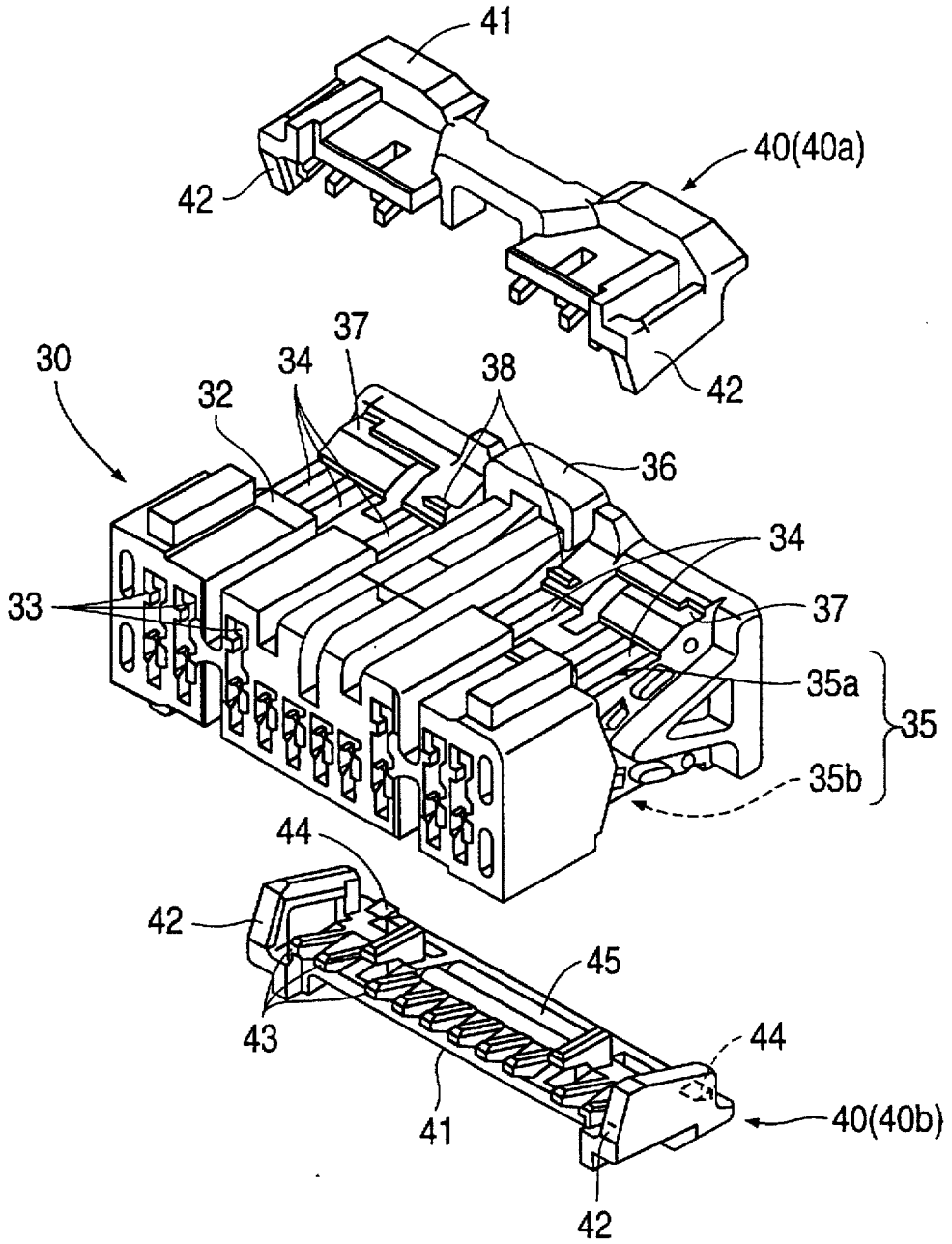
FIG. 4 is an exploded perspective view of a female connector constructed in accordance with the invention.

FIG. 4 shows a female connector 30 having a housing 32 which is insertable into the hood 11 of the male connector 10 from the front thereof. The housing 32 is formed with a plurality of parallel, horizontal cavities 33 which are located in upper and lower rows. Each cavity 33 has a window 34 that opens out, either towards the upper face or the lower face of the housing 32 depending upon whether that cavity is in the upper or lower row. The upper and lower faces define retainer attachment faces 35*a*, 35*b* for attaching a two-part retainer 40 (40*a* and 40*b*).

A flexible locking arm 36 is formed on the upper side of the central portion of the housing 32, the locking arm being provided between the cavities 33 of the upper row, and the retainer attachment face 35*a* on the upper face of the housing being positioned on either side of the locking arm.

The retainer member 40*a* is formed with a laterally-extending base 41 which, in use, covers the upper face of the rear end of the housing 32. Similarly, the retainer member 40*b* has a base 41 for covering the lower face of the rear end of the housing 32. Arms 42 extend substantially at right-angles from both ends of each base 41, so that each retainer member 40*a* and 40*b* is generally C-shaped in cross-section. The arms 42 of each retainer member 40*a* and 40*b* clamp, in use, the side faces of the housing 32 from both sides.

The upper and lower faces of the housing 32 are formed with inclined edge portions which, in use, engage with inclined end surfaces of the arms 42 to permit the retainer members 40*a* and 40*b* to slide onto the housing 32 from the rear, into either an intermediate position or a fully-fitted position (to be described below).

Figure 5:
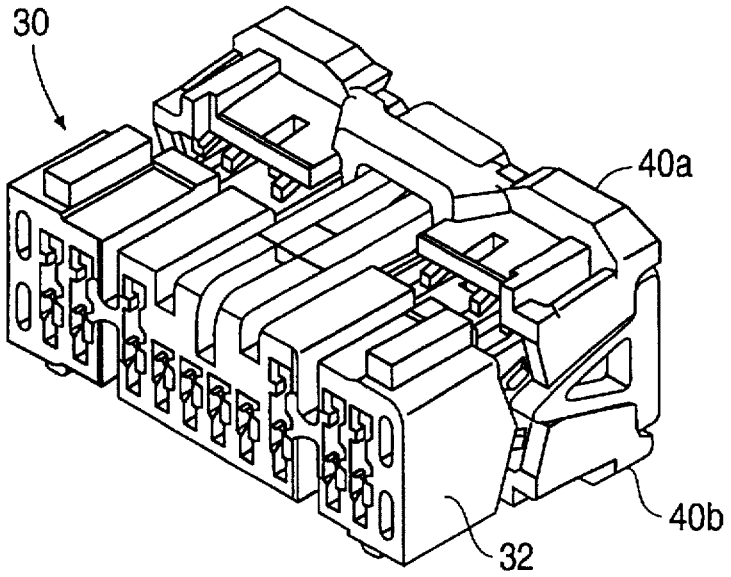
FIG. 5 is a perspective view of the connector of FIG. 4 with its retainer in an intermediate position.
Figure 6:
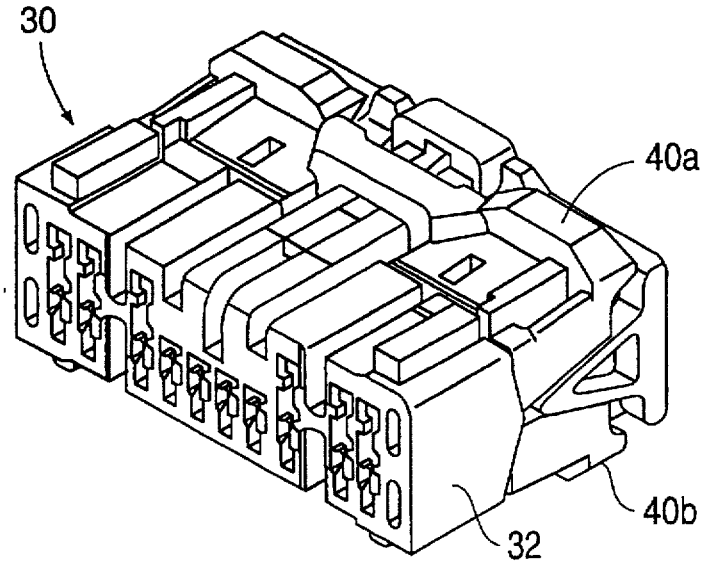
FIG. 6 is a perspective view of the connector of FIG. 4 with its retainer in a fully-fitted position.

As each retainer member 40*a* and 40*b* approaches, or moves away from, its fully-fitted position (shown in FIG. 6), claws 43 formed on its front end move into, or out of, the cavities 33 via the windows 34. In the intermediate position (shown in FIG. 5), the claws 43 are free of the cavities 33.

The retainer attachment faces 35*a* and 35*b* are formed with cut-outs 37 in positions which are adjacent to the roots of the arms 42 when the retainer members 40 and 40*b* move to their fully-fitted positions, the roots of the arms constituting the rear ends of the bases 41 of the retainer members. The retainer members 40*a* and 40*b* are formed with projections 44 that in use, mate with the cut-outs 37. Alternatively, the cut-outs 37 could be formed in the retainer members 40*a* and 40*b*, and the projections 44 could be formed on the retainer attachment faces 35*a*, 35*b*. Either way, the projections 44 mate with the cut-outs 37 when an attempt is made to move the retainer members 40*a* and 40*b* to the rear, thereby inhibiting such a movement.

The retainer attachment face 35*a* is also formed with projections 38 which extend laterally away from the central locking arm 36. These projections 38 are aligned with the base 41 of the retainer member 40*a* when the latter is in the fully-fitted position (see FIG. 6), the projections mating with a laterally-extending slot 45 formed in the base 41 of the retainer member 40*a* in this position. Similarly, the retainer attachment face 35*b* is formed with a central, laterally-extending projection 38 (not shown) which mates with a laterally-extending slot 45 formed in the base 41 of the retainer member 40*b*. Alternatively, other means for controlling rotation of the retainer members 40*a* and 40*b* relative to the housing 32 could be provided in place of the projections 38 and slots 45.

Operation of the female connector 30 is essentially the same as that of the male connector 10. Thus, in the fully-fitted position shown in FIG. 6, the projections 44 formed on the retainer members 40*a* and 40*b* fit into the cut-outs 37 of the housing 32; and the projections 38 formed on the housing 32 mate with the slots 45 of the retainer members. This counteracts any rotational force, thereby preventing the retainer members 40*a* and 40*b* from returning to the intermediate position shown in FIG. 5.

I claim:

1. An electrical connector comprising a housing, a plurality of laterally-spaced parallel cavities formed in the housing for receiving terminals, a retainer for holding the terminals within the cavities, and a respective window joining each of the cavities to the exterior of the housing, the windows being positioned within a housing face overlying the cavities, the retainer having a base, a pair of arms extending away from the ends of the base, and a plurality of claws positioned between the arms and extending away from the base in a given direction, the base of the retainer overlying said housing face with the arms of the retainer clamping a pair of side housing faces adjacent to said housing face and with the claws aligned with the windows, the retainer being movable with respect to the housing in a first direction from a first position in which the claws lie outside the windows to a second position in which the claws have entered the windows, wherein the retainer and the housing are provided with interengageable locking means for resisting movement of the retainer from the second position to the first position in a direction opposed to the first direction, wherein said locking means includes a first locking device which includes at least one primary projection formed in a central region of one of the base of the retainer and the housing face, and a primary cut-out formed in the other of the base of the retainer and the housing face to matingly engage said primary projection, and a second locking device at each end of said housing face to resist rotational movement of the retainer in moving from said second position to said first position, each said second locking device including a secondary projection on one of said base of the retainer and the housing face, and a secondary cut-out on the other of said base of the retainer and the housing face and positioned closely adjacent to one of said arms of said retainer to matingly receive one of said secondary projections.

2. An electrical connector as claimed in claim 1, wherein the locking means of the retainer comprises locking devices positioned at the ends of the base of the retainer and at regions of the base remote from the free ends of the claws.

3. An electrical connector as claimed in claim 2, wherein the locking devices are projections which mate with cut-outs formed in the housing.

4. An electrical connector as claimed in claim 1, wherein the locking means of the retainer comprises laterally-extending locking means positioned in the central region of the base of the retainer.

5. An electrical connector as claimed in claim 4, wherein the laterally-extending locking means of the retainer is a laterally-extending slot which mates with one or more laterally-extending locking projections formed in the housing.

6. An electrical connector as claimed in claim 1, wherein the free ends of the arms of the retainer define inclined end surfaces which are slidingly engageable with complementary inclined surfaces formed on the housing.

7. An electrical connector comprising a housing, first and second rows of laterally-spaced parallel cavities formed in the housing for receiving terminals, a respective first window joining each of the cavities of the first row to the exterior of the housing, the first windows being positioned within a first housing face overlying the cavities of the first row, a respective second window joining each of the cavities of the second row to the exterior of the housing, the second windows being positioned in a second housing face overlying the cavities of the second row, and a respective retainer for holding the terminals within the cavities of the first and second rows, each retainer having a base, a pair of arms extending away from the ends of the base, and plurality of claws positioned between these arms and extending away from that base in a given direction, the base of each retainer overlying the respective first and second housing face with the arms of each retainer clamping a pair of housing faces adjacent to the respective first or second housing face and with the claws aligned with the respective first or second windows, each retainer being movable with respect to the housing in a first direction from a first position in which the claws lie outside the associated windows to a second position in which the claws have entered the associated windows, wherein the retainers and the housing are provided with interengageable locking means for resisting movement of each retainer from the second position to the first position in a direction opposed to the first direction, wherein said locking means includes a first locking device which includes at least one primary projection formed in a central region of each of the bases of the retainers or the housing faces, and primary cut-outs formed in each of the other of the bases of the retainers or the housing faces to matingly engage said primary projections, and a second locking device at each end of each of the housing faces to resist rotational movement of the retainer in moving from said second position to said first position, each said second locking device including a secondary projection and a secondary cut-out positioned closely adjacent to said arms of said retainer to matingly receive one of said secondary projections.

8. An electrical connector as claimed in claim 7, wherein the locking means of each retainer comprises locking devices positioned at the ends of the base of that retainer and at regions of that base remote from the free ends of the claws.

9. An electrical connector as claimed in claim 8, wherein the locking devices are projections which mate with cut-outs formed in the housing.

10. An electrical connector as claimed in claim 7, wherein the locking means of each retainer comprises laterally-extending locking means positioned in the central region of the base of that retainer.

11. An electrical connector as claimed in claim 10, wherein the laterally-extending locking means of each retainer comprises a laterally-extending slot which mates with one or more laterally-extending locking projections formed in the housing.

12. An electrical connector as claimed in claim 7, wherein the free ends of the arms of each retainer define inclined end surfaces which are slidingly engageable with complementary inclined surfaces formed on the housing.

* * * * *